US005321911A

United States Patent [19]

Dickinson

[11] Patent Number: 5,321,911

[45] Date of Patent: Jun. 21, 1994

[54] INTERIOR STORM WINDOW

[76] Inventor: Robert E. Dickinson, 409 S. Downing, Denver, Colo. 80209

[21] Appl. No.: 985,646

[22] Filed: Dec. 7, 1992

[51] Int. Cl.[5] ..... E05D 15/06

[52] U.S. Cl. ..... 49/404; 49/453; 49/501; 16/96 R

[58] Field of Search ..... 49/404, 428, 431, 434, 49/453, 458, 463, 466, 485, 501, 406; 16/90, 95 R, 96 R

[56] References Cited

U.S. PATENT DOCUMENTS

| | | | |
|---|---|---|---|
| 3,305,973 | 2/1967 | Bohn | 49/453 X |
| 3,325,944 | 6/1967 | Crain | 49/453 X |
| 3,466,801 | 9/1969 | Bohn | 49/404 |
| 3,600,857 | 8/1971 | La Barge | 49/404 |
| 3,946,524 | 3/1976 | Budich | 49/428 X |
| 3,965,638 | 6/1976 | Newman | 49/501 X |
| 3,972,165 | 8/1976 | Mock | 49/501 |
| 4,004,629 | 1/1977 | Kelly | 49/413 X |
| 4,248,018 | 2/1981 | Casamayor | 49/63 X |
| 4,478,003 | 10/1984 | Flett | 49/404 |
| 4,483,099 | 11/1984 | Schmidt | 49/63 |
| 4,555,868 | 12/1985 | Mancuso | 49/501 X |
| 4,575,966 | 3/1986 | Gerritsen | 49/464 X |
| 4,825,931 | 5/1989 | Fein | 52/222 X |
| 4,912,807 | 4/1990 | Futch et al. | 16/96 R |
| 5,065,544 | 11/1991 | Martin | 49/453 X |

FOREIGN PATENT DOCUMENTS

| | | | |
|---|---|---|---|
| 2441044 | 7/1980 | France | 49/404 |
| 471306 | 3/1966 | Switzerland | 16/96 R |

*Primary Examiner*—Peter M. Cuomo
*Assistant Examiner*—Jerry Redman
*Attorney, Agent, or Firm*—Linval B. Castle

[57] ABSTRACT

An interior storm window in low thermally conductive ABS sash is slideable in ABS tracks sealed around the interior of a window opening and parallel to an extablished window. Flexible vinyl wiper strips on the rails and stiles of the window sash contact the tracks and adjacent window stiles to render the storm window practically draftproof and comparable to dual pane windows.

4 Claims, 2 Drawing Sheets

INTERIOR STORM WINDOW

This invention relates to storm windows and particularly to a novel draftproof glass window that is installed on the interior window sill adjacent the permanently installed window to form an effective dual pane window that provides both thermal and noise insulation.

Dual pane windows, two parallel glass sheets separated by an air space, have become recognized as a preferred form of window insulation and many communities have enacted building codes requiring dual pane windows in all new residential construction. While dual pane construction may solve the greatest majority of insulation problems, it is not satisfactory if both of the dual panes are mounted in a thermally conductive sash such as aluminum. To eliminate the problem of thermal conduction, some window manufacturers have mounted the panes in wood and at least one has employed a "broken" aluminum sash that has a thermal insulation between dual aluminum sashes.

For both thermal and noise insulation dual pane windows are clearly superior to the single pane window, but because of the cost involved to tear out the old windows of an existing residence to change from single to double pane, the double pane windows are most practical for installation in new construction. Thus the occupants of thousands of existing homes still must pay high heating and cooling bills because their otherwise good ceiling and wall insulation is not adequate to overcome the thermal losses through their single pane windows.

Briefly described, the invention described and claimed herein provides, at low cost, a second interior window slideable in a thermally insulated track which is attached and sealed to the existing window sill and framing. The added window is easily removable for cleaning ease and provides the insulating air space of a dual pane window.

Tests were conducted by a commercial testing laboratory on interior storm windows made in accordance with to the preferred embodiment as disclosed herein indicate that the energy consumption through windows when the interior storm window was installed in tandem with a single pane al sash window.

BRIEF DESCRIPTION OF THE DRAWINGS

In the drawings which illustrate a preferred embodiment of the invention.

DETAILED DESCRIPTION

Figures 2, 4:
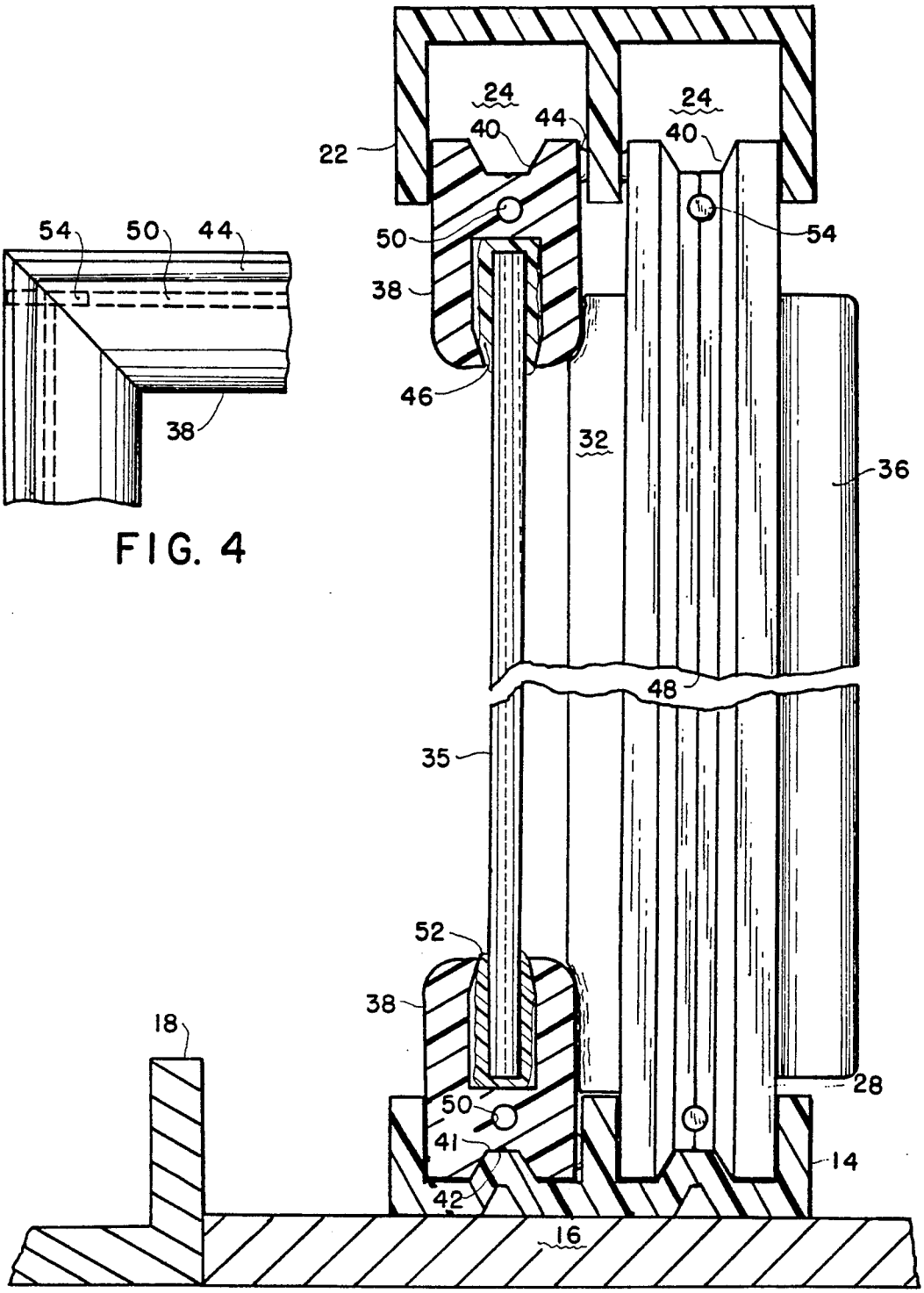
FIG. 2 is an enlarged sectional view taken along the lines 2—2 of FIG. 1.
FIG. 4 is a partial view of a mitered corner of an end stile and upper rail.

Illustrated in the drawings is a double sash horizontal slide window 10,12 each sash slideable in one side of a double width bottom track 14 which rests on, and is cemented to the interior sill 16 adjacent an existing slide window frame 18 as shown in FIG. 2. Aligned with the bottom track 14 and mitered to the ends thereof are double width end stile tracks 20 that are preferably sealed to the side walls of the window opening with a silicone gasket material to prevent air leakage and tacked to prevent movement of the tracks. An identical upper track 22 is secured to the top of the window opening or header and connects the upper ends of the stile tracks 20.

To accommodate the double sash sliding windows, all track material is double width with a ⅛ inch central longitudinal fence separating the tracks for each window panel.

Figure 1:
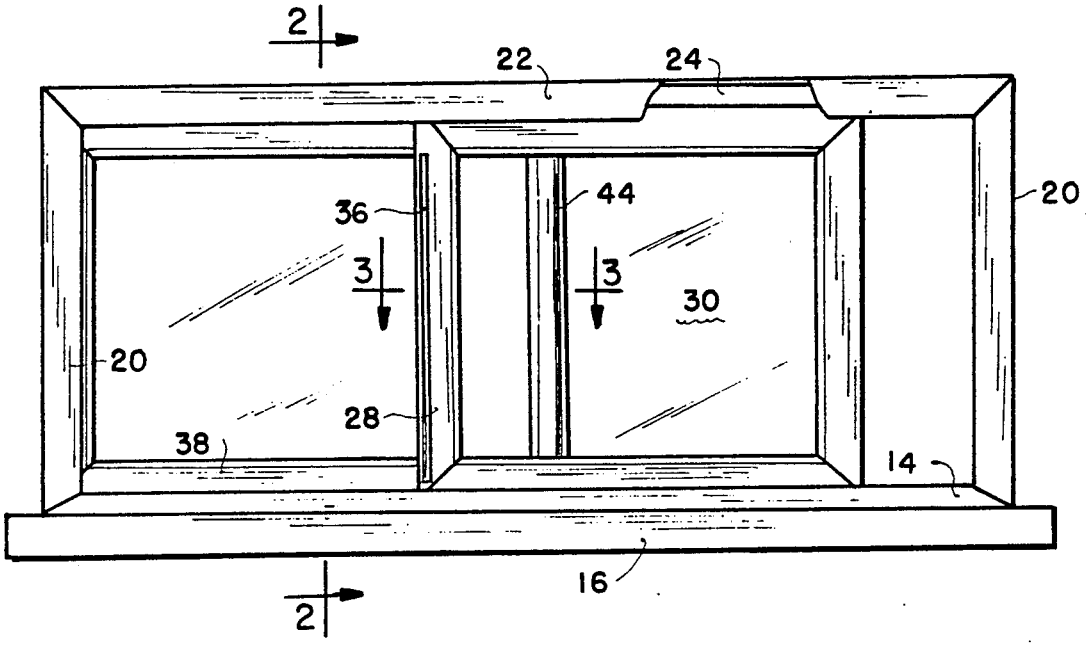
FIG. 1 is an elevational view of a window with two horizontally slideable removable insulating windows.

As shown in FIG. 1, the rectangular frame formed by the double width tracks 14, 20, 22, holds a pair of tandem glass window panels which must slide along the length of the frame between the end tracks 20 and between upper track 22 and bottom track 14 and must be able to be easily removable for cleaning. Therefore, the bottom track which supports the window panels is relatively narrow, having an inside height in which the panels sit of about ⅜ inches while the top edge of the panels extend about ¼ inches into the upper track 22 which has an available depth of about ¾ inch, or approximately twice the depth of the lower track 14. A window panel then may easily be removed from the tracks by lifting the panel from the bottom track 14 into the unused space 24 of the upper track 22 and swinging out the lower end of the panel.

For proper thermal insulation, it is important that the track be formed of a hard, strong material having very low heat conductivity. In the preferred embodiment, the tracks are formed of acrylonitrile butadiene styrene resin, a strong, hard impact resistant substance commonly known as ABS resin.

The periphery of each of the glass window panels is framed in a sash of extruded molding, also formed of ABS resin because of its strength and low heat conductivity. All window panel sash material is identical except for that used for the meeting stile 28 on the inside window 30 shown in FIG. 2 and in the plan view of FIG. 3. That meeting stile is different in that it has a flexible vinyl wiper blade 32 on its outside surface for contacting the flat side surface of the meeting stile 34 of the adjacent outer window panel 35. The central track fence is preferably ⅛ inch thick and thus the spacing between adjacent window moldings is preferably ⅛ inch; the length of the wiper blade 32 is therefore about 3/16 inches. It may be attached to the side surface by any desired way but is preferably co-extruded with the ABS resin. If co-extruded, portions of the vinyl wiper blade 32 must be cut from the ends of the meeting stile to prevent its interference with the upper and lower tracks, 14, 22 during normal operation and particularly the ⅜ inches needed for lifting a window panel into the space 24 for its removal.

Figure 3:
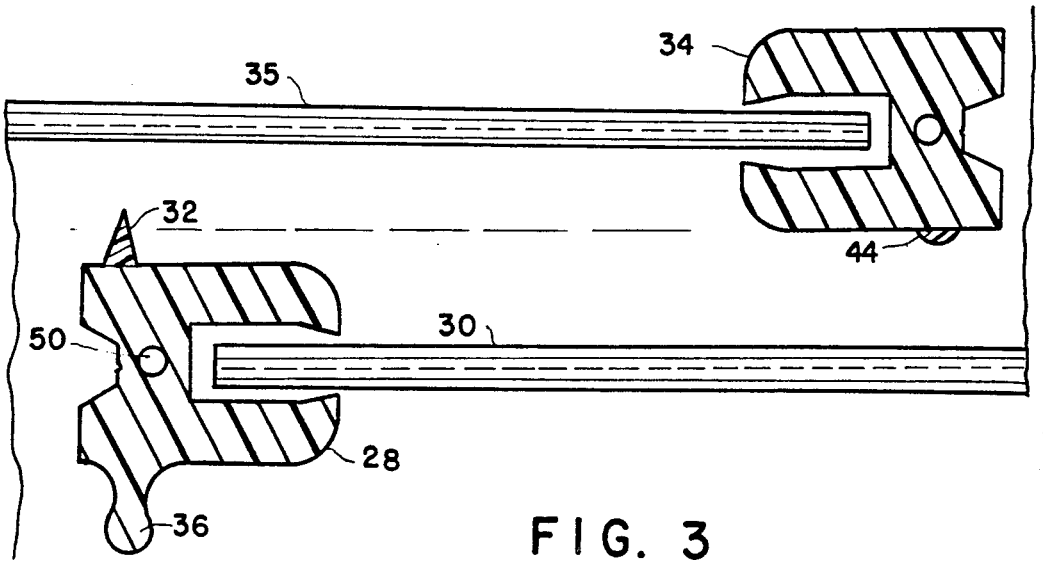
FIG. 3 is an enlarged sectional view taken along the lines 3—3 of FIG. 1.

The meeting stile 28 also differs from the remaining window moldings in that a convenience handle 36 is preferably formed on the inside surface of the stile as shown in FIGS. 2 and 3. Because the ABS resin rail molding slides very easily in the ABS tracks, only a very small convenience handle is desirable; in the preferred embodiment the convenience handle, which is extruded with the molding extends 5/16 inches from the stile surface. As with the wiper blade, portions of the convenience handle 36 must be removed from the ends of the stile to prevent its interference with the upper and lower tracks 14, 22.

FIGS. 2 and 3 illustrate the cross section details of the window moldings, FIG. 2 showing sectional views of the top and bottom tracks and rails and FIG. 3 showing a sectional view of the meeting stiles. As previously stated, all window sash material is identical except the meeting stile molding which is similar except for the added convenience handle 36 and wiper blade 32. In the preferred embodiment, all window sash material is 0.550 inches in width to slide along a track with wall-to-wall spacing of 0.585 inches. All sash moldings 38 have a groove 40 along their bottom surface as shown in FIG. 2. This groove has a maximum width of about ⅛ the width of the molding, a depth of about ⅛ inch and inwardly inclined sidewalls to a flat horizontal portion 41 that rides on top of a track center rail 42 preferably formed only in the bottom track 14 as shown in FIG. 2. The track center rail 42 acts as a guide for its window 30 and very slightly lifts the window from the exposed bottom surface of the bottom track where dust may collect to prevent the smooth easy sliding of a window.

All window sash material, except that for the the meeting stile 28 is preferably formed of ABS resin with a thin co-extruded bulb 44 of flexible polyvinyl on one side surface adjacent the edge having the groove 40. The polyvinyl bulb extends about 0.020 inches from the frame surface and forms a rubbing seal against the walls of the tracks as shown in FIG. 2 and 3.

All window sash material is also formed with a longitudinal glass slot 46 about a half inch deep and a quarter inch wide in the edge opposite the groove 40. The mouth of the slot at the frame edge preferable is reduced to about 0.20 inches and the sharp corners are rounded for appearances. During extrusion of the frame material, a longitudinal hole 50 of about 0.09 inch diameter is formed about half way between the bottom of the slot 40 the the groove horizontal portion 41 for doweling together the mitered corners of the window frames when they are assembled. Also, centered along the groove horizontal portion 41 is a thin groove 48 which merely acts as a drilling guide for the assembler.

After the tracks have been cut, sealed and tacked with short brads around a window opening and on the sill 16, the window sash material is cut with mitered ends and, using the thin groove 48 as a guide, holes are drilled through the ends of the cut sash material at points that will mate with the longitudinal hole 50 in the piece to which the material is to be connected. A strip of vinyl gasket 52 is applied to an edge of a sheet of ⅛ inch glass of the appropriate size and the glass with gasket is forced into the glass slot 46. Each strip of frame material is applied and the mitered corners of the frame are then chemically welded and secured together with a dowel pin 54 prior to lifting the ABS framed window into the tracks.

The above description is for an interior sliding window having two panels that horizontally slide in a double track. It is to be understood that extra wide window openings may be similarly protected by installing three or more interior storm windows in the double width tracks or that the dual width tracks and storm windows may be installed with a suitable locking device in front of the older vertical double-sash windows.

I claim:

1. A thermally insulating window assembly for installation in an existing window opening in an interior of a dwelling, said insulating window assembly comprising of first and second window glass panel:

a double width track frame surrounding and sealed to side walls of the window opening said track frame formed of hard, strong, low heat conductive ABS resin and comprising a lower track interconnected to two side tracks and an upper track said tracks having exterior side walls and a central longitudinal wall separating each track into two equal width identical adjacent tracks;

said upper track having a depth approximately twice that of said lower track for permitting lifting and removing the windows panels therefrom;

said window panels having a total width and height corresponding to that of said track frame, each of said window panels having a bottom rail, a top rail, an end stile having a height and a meeting stile, said rails and stiles being formed of ABS resin, said rails and stiles having a width slightly less than that of each of track of said double width track frame into which said window panels are placed;

said meeting stile of said first window panel having a flexible wiper blade on a first side surface for wiping contact with the meeting stile on said second window panel, said flexible wiper blade having a height substantially corresponding to the length of the meeting stile of said second window panel, said meeting stile of said first window panel having on its opposite side surface an extending convenience handle; and a flexible wiper bulb of flexible polyvinyl co-extruded in at least one side surface of said end stiles the meeting stile of said second window panel, and said top and bottom rails, said wiper bulb extending outward for rubbing contact with said track walls.

2. The insulating window claimed in claim 1 wherein the ABS vinyl material in said end and meeting stiles and said top and bottom rails is formed with a longitudinal hole therethrough for receiving assembly dowels during assembly of a sash for a glass pane.

3. The insulating window claimed in claim 2 wherein said end and meeting stiles and said top and bottom rails have longitudinal glass slots for receiving a window glass and wherein said window glass is sealed in said slots with a vinyl gasket material.

4. The insulating window claimed in claim 1 wherein said bottom rails has a longitudinal groove along its bottom surface, said groove having inclined sides for tightly engaging a longitudinal rail in said lower track.

* * * * *